US012421655B2

(12) United States Patent
Wu et al.

(10) Patent No.: US 12,421,655 B2
(45) Date of Patent: Sep. 23, 2025

(54) DEEPENING GARMENT-PROTECTING TABLET, PREPARATION METHOD AND USE METHOD THEREOF

(71) Applicant: FOSHAN MAGIC CRYSTAL TECHNOLOGY DEVELOPMENT CO., LTD., Guangdong (CN)

(72) Inventors: Jiyuan Wu, Foshan (CN); Fengsheng Wang, Foshan (CN); Chiseng Wong, Foshan (CN)

(73) Assignee: FOSHAN MAGIC CRYSTAL TECHNOLOGY DEVELOPMENT CO., LTD., Guangdong (CN)

( * ) Notice: Subject to any disclaimer, the term of this patent is extended or adjusted under 35 U.S.C. 154(b) by 0 days.

(21) Appl. No.: 18/727,515

(22) PCT Filed: Mar. 14, 2024

(86) PCT No.: PCT/CN2024/081764

§ 371 (c)(1),
(2) Date: Jul. 9, 2024

(87) PCT Pub. No.: WO2025/007586

PCT Pub. Date: Jan. 9, 2025

(65) Prior Publication Data

US 2025/0207322 A1 Jun. 26, 2025

(30) Foreign Application Priority Data

Dec. 22, 2023 (CN) ..... 202311783754.4

(51) Int. Cl.

| | |
|---|---|
| ***D06M 15/643*** | (2006.01) |
| ***D06M 11/79*** | (2006.01) |
| ***D06M 13/46*** | (2006.01) |
| ***D06M 15/263*** | (2006.01) |

(52) U.S. Cl.

CPC ..... *D06M 15/643* (2013.01); *D06M 11/79* (2013.01); *D06M 13/46* (2013.01); *D06M 15/263* (2013.01); *D06M 2200/00* (2013.01)

(58) Field of Classification Search

CPC ..... D06M 13/46

See application file for complete search history.

(56) References Cited

FOREIGN PATENT DOCUMENTS

| | | | | | |
|---|---|---|---|---|---|
| CN | 101067292 | A | | 11/2007 | |
| CN | 103614910 | A | | 3/2014 | |
| CN | 107723132 | A | * | 2/2018 | ..... C11D 10/04 |
| CN | 110106699 | A | | 8/2019 | |
| CN | 110359287 | A | | 10/2019 | |
| CN | 116043541 | A | | 5/2023 | |
| JP | 2000282376 | A | | 10/2000 | |

OTHER PUBLICATIONS

Qian (English abstract of CN 107723132 A). (Year: 2018).*

Written Opinion issued on Sep. 9, 2024, in corresponding International Application No. PCT/CN2024/081764, 8 pages.

* cited by examiner

*Primary Examiner* — Peter F Godenschwager

(74) *Attorney, Agent, or Firm* — Maier & Maier, PLLC

(57) ABSTRACT

A deepening garment-protecting tablet, a preparation method and a use method thereof and relates to the field of garment auxiliaries. The deepening garment-protecting tablet includes a carrier tablet and a base material; in parts by weight, the base material includes 20 to 80 parts of a deepening agent and 5 to 20 parts of a quaternary ammonium salt surfactant; the quaternary ammonium salt surfactant acts on the deepening agent under the condition of stirring and heating to make long chains of molecules of the deepening agent is opened. The deepening garment-protecting tablet uses the quaternary ammonium salt surfactant as an aid to open the molecular chains of the deepening agent in a anhydrous state, so as to facilitate the deepening agent to the surface of the garment, improve the diffuse reflection of the garment and deepen the color of the garment.

9 Claims, No Drawings

DEEPENING GARMENT-PROTECTING TABLET, PREPARATION METHOD AND USE METHOD THEREOF

TECHNICAL FIELD

The present disclosure relates to the technical field of garment auxiliaries, in particular to a deepening garment-protecting tablet, a preparation method and a use method thereof.

BACKGROUND

During the long-term use of garments, garments will become rough and hard due to washing and wear, and the color will deteriorate and whiten, and even the problems that dark color is not deep and black color is not black. Although the garments can become soft and smooth by the treatment of softener after washing, the problem of whitening and aging of garments has not been solved because the existing garment-protecting tablets do not have the function of deepening. In the prior art, only reagents and methods for deepening the fabric or garments before leaving the factory are disclosed, for instance, in the post-finishing process of the fabric, the fabric is treated with silicone oil or other deepening agents to improve the diffuse reflection of light on the fabric to achieve the deepening effect. However, in the prior art, the reagents and methods for deepening the fabric are not suitable for the deepening treatment of garments after leaving the factory, because the deepening agent used for deepening the fabric is usually macromolecular silicone oil or modified silicone oil and acrylate polymer (with a weight-average molecular weight of tens of thousands to hundreds of thousands), so emulsification treatment should be performed before use, for instance, after the deepening agent is completely dispersed in water by emulsifier, it can be evenly covered on the surface of the fabric. However, in daily garment washing, the emulsifier is not added, so the deepening agent used for fabric cannot be used in daily garment washing process; in addition, due to a lot of emulsifiers are needed in the process of deepening agent emulsification, the ratio of oil to emulsifier is up to (4~6):1, and the traditional emulsifier is usually fatty alcohol polyoxyethylene ether AEO-3~9, heterogeneous alcohol polyoxyethylene ether TO3~8, nonylphenol polyoxyethylene ether NP-3~10, etc., these materials are difficult to microbial degrade or have a very long degradation cycle, if used for family garments treatment, the formed wastewater direct discharge will be easy to cause an adverse impact on the environment.

Therefore, the prior art still needs to be improved and advanced.

According to the above-mentioned defect of the prior art, the purpose of the present disclosure is to provide a deepening garment-protecting tablet, a preparation method and a use method thereof to solve the defect of deepening agents used for fabric finishing cannot be used for daily deepening treatment of old garments in the prior art.

To achieve the above-mentioned purpose, the following technical schemes are adopted in the present disclosure:

A deepening garment-protecting tablet includes a carrier tablet and a base material; in parts by weight, the base material includes 20 to 80 parts of a deepening agent and 5 to 20 parts of a quaternary ammonium salt surfactant; the quaternary ammonium salt surfactant acts on the deepening agent under a condition of stirring and heating to open long chains of molecules of the deepening agent.

In the deepening garment-protecting tablet, the quaternary ammonium salt surfactant is a combination of one or more of fatty acid amide ethoxy quaternary ammonium salt, fatty acid imidazoline quaternary ammonium salt, and fatty acid ester quaternary ammonium salt.

In the deepening garment-protecting tablet, the deepening agent is a combination of one or more of silicone oil, modified silicone oil, and acrylate polymer.

In the deepening garment-protecting tablet, the carrier tablet is a slice-shaped tablet made of one or more of modified starch, modified cellulose or hemicellulose, and modified lignin.

In the deepening garment-protecting tablet, a weight ratio of the carrier tablet to the base material is 1:(1~10).

In the deepening garment-protecting tablet, the base material further includes a spice and a spice carrier.

In the deepening garment-protecting tablet, the spice carrier is kaolin or clay.

In the deepening garment-protecting tablet, in parts by weight, the base material includes 0.1 to 50 parts of the spice and 5 to 30 parts of the spice carrier.

A method for preparing the above-mentioned deepening garment-protecting tablet includes follow steps: obtaining and heating a deepening agent to melt; adding a quaternary ammonium salt surfactant into the molten deepening agent, and stirring and mixing uniformly; adding a spice carrier, and stirring uniformly; adjusting a temperature of a stock body to 50 to 70° C., adding a spice, and uniformly stirring to obtain a base material in a molten state; soaking a cut carrier tablet in the molten base material for 10 to 30 seconds; pulling the cut carrier tablet out and pressing to flat with a roller of 10 to 70 meshes, and then cooling to form to obtain the deepening garment-protecting tablet.

A method for using a deepening garment-protecting tablet, the deepening garment-protecting tablet is the above-mentioned deepening garment-protecting tablet; the use method includes adding the deepening garment-protecting tablet in a process of drying garment to make the garment bright in color.

Beneficial Effects:

The present disclosure provides a deepening garment-protecting tablet, a preparation method and a use method thereof. By adding the quaternary ammonium salt surfactant into the deepening agent, the quaternary ammonium salt surfactant can open the molecule chain of the deepening agent at an anhydrous state, and the deepening agent with opened molecular chain can be used to act on the surface of the garment in the process of drying garment to improve the diffuse reflection of garment and deepen the color of the garment. In addition, the deepening agent and the quaternary ammonium salt surfactant can also make the garment softer, smoother, and fluffier, and have a nursing effect on the garment.

DETAILED DESCRIPTION OF EMBODIMENTS

The present disclosure provides a deepening garment-protecting tablet, and preparation method and use method thereof. In order to make the purposes, the technical schemes, and effects of the present disclosure more clear and definite, more details of the present disclosure are completely described in combination with the embodiments of the present disclosure. Obviously, the described embodiments are only used to explain the present disclosure, not to limit the present disclosure.

In a better embodiment, the present disclosure provides a deepening garment-protecting tablet, including a carrier tablet and a base material attached to the carrier tablet; the base material includes a quaternary ammonium salt surfactant and a deepening agent; in parts by weight, the base material includes 20 to 80 parts of the deepening agent and 5 to 20 parts of the quaternary ammonium salt surfactant. the quaternary ammonium salt surfactant acts on the deepening agent under the condition of stirring and heating to open long chains of molecules of the deepening agent. In the subsequent use process, the deepening agent with opened molecular chains can directly attach to the surface of the garment, so as to improve the diffuse reflection of garment and deepen the color of the garment. Meanwhile, the deepening agent and the quaternary ammonium salt surfactant can also make the garment softer, smoother, and fluffier, and have a nursing effect on the garment.

Since the existing deepening agent in the prior art needs to be used after emulsifier emulsification, however during the emulsification process a large quantity of water must be added, a ratio of effective components in the deepening agent product is reduced by 50 to 85%. Therefore, the deepening agent emulsion for sale includes a large quantity of water, greatly increasing the transportation costs. Moreover, because of the large quantity of emulsifiers, the deepening agent is only used for color deepening of the fabric, not for color deepening of the daily garment. However, in the embodiment of the present disclosure, by adding the quaternary ammonium salt surfactant into the deepening agent, using the interaction of the quaternary ammonium salt surfactant and deepening agent after melting to open the molecule chain of the deepening agent at an anhydrous state, and then obtain solid-state tablets. Compared with the existing deepening agent used in fabric, in the present disclosure, the content of active ingredients is higher, the transportation cost is lower, the storage time is longer, and it is no longer limited to the use of fabric finishing, but also can be used in the process of drying garment, to achieve the deepening effect of wearing old white garment.

In the deepening garment-protecting tablet, the deepening agents include a combination of one or more of silicone oil, modified silicone oil and acrylate polymer, all of which are compounds with long chain macromolecular. The quaternary ammonium salt surfactant can be selected from diamide ethyl alkoxy quaternary ammonium compounds, dialkyl dimethyl quaternary ammonium compounds, ester quaternary ammonium compounds, amide ethyl alkyl imidazoline quaternary ammonium compounds, etc. When preparing the garment-protecting tablet, the quaternary ammonium salt surfactant can open the molecular chain of the molten deepening agent, so that the deepening agent can be better attached to the surface of the garment. Specifically, when preparing the garment-protecting tablet, the quaternary ammonium salt surfactant interacts with the deepening agent in the molten state. A hydrophobic end is combined with silicone oil, modified silicone oil or acrylate polymer, opening the molecular chain of silicone oil, modified silicone oil, and acrylate polymer under the action of stirring, so as to be better dispersed in the base material, which is equivalent to the effect of deepening agent dispersed in water under the action of emulsifier. Therefore, in the subsequent use process, the deepening garment-protecting tablet can be used without the action of emulsifier. While in use, by the heating effect of drying, the cations of the quaternary ammonium salt surfactant interact with the anions of the garment fiber to enter the garment fiber to repair the fiber and make the fiber more compliant. Meanwhile, the macromolecular deepening agent is attached to and stays on the surface of the fiber under with the quaternary ammonium salt surfactant, and under the high temperature action of the dryer to shape. The deepening agent improves the diffuse reflection of garment and deepens the color of the garment, make dark color darker and light color fresher.

However, although the quaternary ammonium salt surfactant can act with the deepening agent, a biodegradability of the quaternary ammonium salt surfactant is poor and unfriendly to the environment. So here, in a better embodiment, the quaternary ammonium salt surfactant is a combination of one or more of fatty acid amide ethoxy quaternary ammonium salt, fatty acid imidazoline quaternary ammonium salt, fatty acid ester-quaternary ammonium salt. These quaternary ammonium salt surfactants are prepared from plant-based fatty acids, have better biodegradability and are therefore more environmentally friendly. To be noted that, the fatty acid amide ethoxy quaternary ammonium salt, fatty acid imidazoline quaternary ammonium salt, fatty acid ester-quaternary ammonium salt are all purchased from Nanfeng County Daxin Technology Co., LTD.

In order to increase the fragrance of the garment-protecting tablet, at the same time make the deepening garment-protecting tablet has the fragrance effect on the garment, the base material also includes a spice and a spice carrier; the spice includes free essence or essence micro capsule, the free essence or essence micro capsule can be attached to the garment surface, has the effect of fragrance or slowly release fragrance, can improve the user experience of garment.

In a better embodiment, the spice carrier is kaolin or clay. Take kaolin or clay as the spice carrier can improve the adhesion force of the base material and the carrier tablet, conducive to improve the proportion of the base material, and then improve the effect of deepening. Moreover, both kaolin and clay are inorganic to improve dry degree, which is more beneficial to the subsequent production process.

In a better embodiment, in parts by weight, the base material includes 20 to 80 parts of the deepening agent, 5 to 20 parts of the quaternary ammonium salt surfactant, 0.1 to 50 parts of the spice, and 5 to 30 parts of the spice carrier. The proportion of the garment-protecting tablet make the garment has a better color deepening, smooth, fragrance effect.

In the garment-protecting tablet, the carrier tablet is a non-woven fabric made of PVC, PET and PP, and the non-woven fabric has a porous layered structure, and can be used as a carrier for the deepening agent and the quaternary ammonium salt surfactant, so as to facilitate the formation of a tablet structure, convenient packaging, storage and transportation according to the volume, and convenient to determine the input quantity of the garment-protecting tablet according to the quantity of garments when in use. However, the non-woven fabric made of PVC, PET and PP cannot be degraded after use, which is not friendly to the environment and does not conform to the development concept of environmental protection. So here, in a better embodiment, the carrier tablet is a tablet prepared from one or more of modified starch, modified cellulose or hemicellulose and modified lignin. Because the modified starch, modified cellulose or hemicellulose and modified lignin are biodegradable materials, the residual carrier tablet can be degraded in the environment after the garment-protecting tablet is used, so it will not affect the environment and is more environmentally friendly.

However, a loading capacity of the carrier tablet on the deepening agent, the quaternary ammonium salt surfactant, the spice and the spice carrier is limited. When the loading capacity reaches a certain quantity, increasing the loading capacity of the base material will make the flexibility of the tablet insufficient and the base material will easily peel off. So here, in a better embodiment, the weight ratio of the carrier tablet to the base material is 1:(1~10), which can make the obtained garment-protecting tablet have better flexibility and deepening effects. Meanwhile, when the tablet is folded, the base material will not peel off. Optionally, the weight ratio of the carrier tablet to the base material is 1:(1-6). More optionally, the weight ratio of the carrier tablet to the base material is 1:(1~4), and the flexibility of the tablet is better.

In a second aspect, the present disclosure provides a method for preparing the deepening garment-protecting tablet, including follow steps: taking a deepening agent according to a proportion and heating to melt; adding a quaternary ammonium salt surfactant into the molten deepening agent, and stirring and mixing uniformly to fully mix the two; adding a spice carrier, and stirring uniformly; adjusting a temperature of a stock body to 50 to 70° C., adding a spice, and uniformly stirring to obtain a base material in a molten state; soaking a cut carrier tablet in the molten base material for 10 to 30 seconds; pulling the cut carrier tablet out and pressing to flat with a roller of 10 to 70 meshes, and then cooling to form to obtain the deepening garment-protecting tablet.

In the above mentioned deepening garment-protecting tablet, the deepening agent is melted by heating, and then the quaternary ammonium salt surfactant is added into the deepening agent. By using the interaction of the quaternary ammonium salt surfactant and deepening agent, a molecule chain of the macromolecular deepening agent at an anhydrous state is opened, so that the deepening agent can exert the deepening effect in the use process and be well dispersed in the base material. The prepared garment-protecting tablet is an anhydrous solid tablet, so the transportation cost can be greatly reduced.

In a third aspect, the present disclosure provides a method for using the deepening garment-protecting tablet, including follow steps: adding garment-protecting tablets into a dryer before a garment drying process, and a drying temperature of the garment drying process is 90 to 120° C., a drying time is 30 to 120 minutes, an addition quantity of the garment-protecting tablets is one piece of tablet for 4 to 8 garments, and a weight of each piece of garment-protecting tablet is 1.8 to 10.0 g. In the embodiment, the base material components attached to a carrier tablet are melted by a high temperature when garments are drying, and a deepening agent, a quaternary ammonium salt surfactant and a spice in the base material are transferred to a surface of the garments by a high-speed rotation of the garments, so as to deepen, soften and enhance the fragrance of the garments. After the garment drying procedure is finished, all the effective components in the carrier tablet are basically transferred to the garments, and only the carrier tablet remains. Therefore, after the garments are taken out, the carrier tablet is removed, and the carrier tablet can be slowly biodegraded in the environment without affecting the environment.

It should be noted that the ratio of garments to garment-protecting tablets is an empirical value, which can be changed according to actual needs, and is not limited to the above ratio.

In the embodiment of the method for using a deepening garment-protecting tablet, the deepening garment-protecting tablet does not need to be dissolved in water, and is not limited to be used in the fabric finishing process, and the deepening garment-protecting tablet is especially suitable for use in the garment drying process. Since the deepening garment-protecting tablet is a solid tablet, it is necessary to melt, volatilize or evaporate the effective components in the base material by the temperature when the garments are drying and then by the high-speed rotation when the garment are drying, so that these effective components can be uniformly attached to the surface of the garment and have a corresponding effect.

It can be seen that the deepening garment-protecting tablet described in the present disclosure has the function of deepening the color of garments and making garments softer, smoother and fluffier. Because the deepening garment-protecting tablet is in a tablet form, it is convenient to store, transport and use. In addition, the deepening garment-protecting tablet can be used when garments are drying, which breaks the limitation that the existing deepening agent can only be used in the later finishing of fabrics, and solves the technical problem that garments become old and white when used for a long time.

In order to further illustrate a deepening protective garment piece provided by the present disclosure, the following examples are provided:

Example 1

A deepening garment-protecting tablet, including a non-woven slice-shaped carrier tablet and a base material attached to a surface of the carrier tablet, and the weight ratio of the carrier tablet to the base material is 1:4; in parts by weight, the base material includes 60 parts of the modified silicone oil, 10 parts of the fatty amide ethoxylated quaternary ammonium salt, 20 parts of the spice, and 15 parts of the kaolin.

A method for preparing the garment-protecting tablet includes: a deepening agent was taken according to a proportion and was heat to melt; a quaternary ammonium salt surfactant was added into the molten deepening agent, and stirred and mixed uniformly to fully mix the two; a spice carrier was added and stirred uniformly; a temperature of a stock body was adjusted to 62° C., and a spice was added and uniformly stirred to obtain a base material in a molten state; a cut carrier tablet was soaked in the molten base material for 20 seconds; the carrier tablet out was pulled and flatted with a roller of 10 to 70 meshes, and then cooled to form to obtain the deepening garment-protecting tablet.

Example 2

A deepening garment-protecting tablet, including a non-woven slice-shaped carrier tablet and a base material attached to a surface of the carrier tablet, and the weight ratio of the carrier tablet to the base material is 1:1; in parts by weight, the base material includes 80 parts of the silicone oil, 20 parts of the fatty amide ethoxylated quaternary ammonium salt, 0.1 parts of the spice, and 5 parts of the kaolin.

Example 3

A deepening garment-protecting tablet, including a non-woven slice-shaped carrier tablet and a base material attached to a surface of the carrier tablet, and the weight ratio of the carrier tablet to the base material is 1:10; in parts by weight, the base material includes 20 parts of the acrylate polymer, 5 parts of the fatty acid imidazoline quaternary ammonium salt, 50 parts of the spice, and 30 parts of the clay.

Example 4

A deepening garment-protecting tablet, including a non-woven slice-shaped carrier tablet and a base material attached to a surface of the carrier tablet, and the weight ratio of the carrier tablet to the base material is 1:6; in parts by weight, the base material includes 40 parts of the modified silicone oil, 15 parts of the fatty acid ester-quaternary ammonium salt, 30 parts of the spice, and 10 parts of the clay.

It should be noted that, the method for preparing a deepening garment-protecting tablet in Examples 2 to 4 is the same as the preparation method in Example 1.

Comparative Example 1

A garment-protecting tablet, including a non-woven slice-shaped carrier tablet and a base material attached to a surface of the carrier tablet, and the weight ratio of the carrier tablet to the base material is 1:6; in parts by weight, the base material includes 55 parts of the fatty acid ester quaternary ammonium salt, 30 parts of the spice, and 10 parts of the kaolin.

Comparative Example 2

A garment-protecting tablet, including a non-woven slice-shaped carrier tablet and a base material attached to a surface of the carrier tablet, and the weight ratio of the carrier tablet to the base material is 1:6; in parts by weight, the base material includes 40 parts of the modified silicone oil, 15 parts of the fatty acid amide acetate, 30 parts of the spice, and 10 parts of the kaolin.

Comparative Example 3

A garment-protecting tablet, including a non-woven slice-shaped carrier and modified silicone oil attached to a surface of the carrier, and the weight ratio of the carrier to the modified silicone oil is 1:6.

Performance Test

Fluffy degree: running a self-cleaning mode and cleaning a washing machine until there is no foam. Putting a new towel into the washing machine (Haier XQS100-BZ368Z), washing off floating hair on the towel surface in a standard mode without adding detergent, and drying naturally. The washing machine was adjusted to the standard mode, and the parameters were set as follows:

Water level: 2nd gear (29 L);

Soaking: 30 minutes;

Washing: 25 minutes;

Rinse: once;

Dehydration: 4 minutes.

After the parameters were set, 12 towels were put into the washing machine, 30 g standard laundry detergent were added into a trough of the washing machine, a lid was closed, a laundry program then was started, and as a washing process was recorded when the laundry program was over. After washing, the towels were taken out and putted into a dryer. The drying temperature of the drying procedure was 90° C. and the drying time was 60 min. The garment-protecting tablets prepared in Examples 1 to 4 and Comparative Examples 1 to 3 were putted on the towels in batches, and the program was started, which was counted as one process. The above washing and drying process was repeated for 5 times. After drying, the towels were folded horizontally and then vertically into a square block, and then the folded square towels were stacked together to test the overall height, so as to judge the fluffy degree of the towels. In addition, another 12 towels were used as control samples, washed and dried according to the above procedures, and no reagent was added during drying.

An antistatic coefficient, a deepening rate and a softness index: according to the above fluffy method, 12 towels were replaced by 6 black polyester chiffon garments, which were also repeated for 5 times. The antistatic index of the dried garments was tested according to QB/T 4535. Then, according to the method specified in GB/T 6688, the K/S value of the humidified fabric was measured with a colorimeter. Then the deepening rate is $$\Delta T/\% = \frac{K/S_{after} - K/S_{before}}{K/S_{before}} \times 100;$$

finally, six experienced hand feel assessors were asked to test the softness, and the perfect score was 10, which was used to evaluate the hand feel of seven groups of experimental garments.

The specific test results were shown in Table 1.

| Sample | Deepening rate/ % | Fluffy degree/ cm | Softness index | Antistatic property (based on the difference between the pair values of surface specific resistance)/ ΔLgp_ |
|---|---|---|---|---|
| Example 1 | 40 | 33.5 | 9.8 | 8 |
| Example 2 | 32 | 29.2 | 9.5 | 7.5 |
| Example 3 | 20 | 25.2 | 7.5 | 5.5 |
| Example 4 | 48 | 28.3 | 8.8 | 6 |
| Comparative Example 1 | 0 | 30 | 7 | 6.2 |
| Comparative Example 2 | 12 | 23.5 | 4 | 3 |
| Comparative Example 3 | 5.5 | 20 | 2 | 2.5 |
| Control samples | 0 | 20 | 2 | 2.5 |

According to Table 1, the deepening garment-protecting tablets described in Examples 1 to 4 have good depth-deepening effects, and the deepening rate of garment color is above 20%, and the fluffy degree, softness and antistatic property of fabrics can also be improved. However, the deepening rate of Comparative Example 1 is 0, which does not have the deepening effect, because no deepening agent is added to its base material. Although Comparative Example 2 can make garments fluffy, soft and deepening, it is worse than Example 4, mainly because the softener used is not a quaternary ammonium salt surfactant, so the opening effect on the molecular chain of modified silicone oil is not obvious, which leads to the poor deepening effect of modified silicone oil. Comparative example 3 has a certain deepening effect, but the deepening effect is not significant when the quantity of modified silicone oil is large, which shows that the molecular chain of modified silicone oil is difficult to open without quaternary ammonium salt surfactants, which leads to its failure to play a normal deepening role.

It can be understood that those skilled in the art can make equivalent substitutions or changes according to the technical schemes of the present disclosure and its inventive concept, and all these changes or substitutions should belong to the protection scope of the appended claims.

What is claimed is:

1. A deepening garment-protecting tablet, comprising a carrier tablet and a base material, wherein, in parts by weight, the base material comprises 20 to 80 parts of a deepening agent and 5 to 20 parts of a quaternary ammonium salt surfactant; wherein the deepening agent is a combination of one or more of silicone oil, modified silicone oil, and acrylate polymer; and wherein the quaternary ammonium salt surfactant interacts with the deepening agent in a molten state under a condition of stirring and heating to improve molecular dispersion of the molecular chains of the deepening agent.

2. The deepening garment-protecting tablet according to claim 1, wherein the quaternary ammonium salt surfactant is a combination of one or more of fatty acid amide ethoxy quaternary ammonium salt, fatty acid imidazoline quaternary ammonium salt, and fatty acid ester quaternary ammonium salt.

3. The deepening garment-protecting tablet according to claim 1, wherein the carrier tablet is a tablet made of one or more of modified starch, modified cellulose or hemicellulose, and modified lignin.

4. The deepening garment-protecting tablet according to claim 3, wherein a weight ratio of the carrier tablet to the base material is 1:(1~10).

5. The deepening garment-protecting tablet according to claim 1, wherein the base material further comprises a fragrance and a fragrance carrier.

6. The deepening garment-protecting tablet according to claim 5, wherein the fragrance carrier is kaolin or clay.

7. The deepening garment-protecting tablet according to claim 5, wherein in parts by weight, the base material comprises 0.1 to 50 parts of the fragrance and 5 to 30 parts of the fragrance carrier.

8. A method for preparing a deepening garment-protecting tablet according to claim 1, the method comprising: obtaining and heating a deepening agent to melt; adding a quaternary ammonium salt surfactant into the molten deepening agent, and stirring and mixing uniformly; adding a fragrance carrier, and stirring uniformly; adjusting a temperature of a stock body to 50 to 70° C., adding a fragrance, and uniformly stirring to obtain a base material in a molten state; soaking a cut carrier tablet in the molten base material for 10 to 30 seconds; and pulling the cut carrier tablet out and pressing to flat with a roller of 10 to 70 meshes, and then cooling to form to obtain the deepening garment-protecting tablet.

9. A method for using a deepening garment-protecting tablet according to claim 1, the method comprising: adding a deepening garment-protecting tablet in a process of drying garment to make the garment bright in color.

* * * * *